United States Patent [19]

Rolffs

[11] Patent Number: 4,959,076

[45] Date of Patent: Sep. 25, 1990

[54] SYNTHETIC ROSEWOOD AND METHOD OF PRODUCTION THEREOF

[76] Inventor: Philip C. Rolffs, 629 S. Shore Dr., P.O. Box 175, Portage, Mich. 49081

[21] Appl. No.: 350,510

[22] Filed: May 11, 1989

Related U.S. Application Data

[63] Continuation-in-part of Ser. No. 206,190, Jun. 10, 1988, Pat. No. 4,840,637, which is a continuation of Ser. No. 933,478, Nov. 21, 1986, abandoned.

[51] Int. Cl.[5] ..... D06P 3/60
[52] U.S. Cl. ..... 8/402; 8/506
[58] Field of Search ..... 8/402

[56] References Cited

U.S. PATENT DOCUMENTS 4,840,637 6/1989 Rolffs ..... 8/402

*Primary Examiner*—Paul Lieberman
*Assistant Examiner*—John F. McNally
*Attorney, Agent, or Firm*—Gordon W. Hueschen

[57] ABSTRACT

A process of treating wood of the genus Juglans to change its color completely and throughout its entire structure and substance so as to produce a product with a color consisting of various shades of dark brown with conspicuous black streaks which duplicates the color of natural rosewood, thereby providing a synthetic rosewood or rosewood substitute, and the product produced thereby, are all described herein.

24 Claims, No Drawings

SYNTHETIC ROSEWOOD AND METHOD OF PRODUCTION THEREOF

This application is continuation-in-part of my prior-filed copending application Ser. No. 206,190, filed June 10, 1988, now U.S. Pat. No. 4,840,637, issued June 20, 1989, which in turn was a continuation of my prior-filed copending application Ser. No. 933,478, filed Nov. 21, 1986, now abandoned.

In my prior application Ser. No. 206,190, I disclosed synthetic ebony having bronze highlights and a method for the production thereof, including an ultimate drying step. Now, to my surprise, I have found that a variation in the drying step produces totally unpredictable results, namely, the dissipation or evaporation, or at least disappearance, of some of the color from the product, while residual darkened streaks remain, giving the product the pleasing and desirable appearance of rosewood. Although I do not understand the mechanism behind this difference and accordingly cannot be bound by any theory as to how or why it occurs, the result is clear. It would appear that the employment of the elevated temperature, as claimed herein for the production of the "synthetic rosewood", partially destroys the black substance or material created by some chemical reaction within the Juglans wood according to my prior application and process, to produce a wood which is lighter-colored and more conspicuously streaked than that produced according to my prior invention, namely, a wood having various shades of dark brown with even darker, i.e., black, streaks, very similar to rosewood, a highly desirable result in that rosewood is itself in considerable demand, short supply, and under economic pressure. The present invention, accordingly, surprisingly and unpredictably fulfills a desirable industrial objective and provides what may be referred to as a "synthetic rosewood" or "rosewood substitute" employing only a minor but specific variation of my prior process by employing a temperature in the drying step which is elevated compared to those drying temperatures previously employed by me according to my prior invention and application.

FIELD OF INVENTION

Wood of the genus Juglans having a color which is essentially dark brown (of various shades) with conspicuous black streaks completely and throughout its entire structure and substance, thereby providing a rosewood substitute, and method of producing the same.

BACKGROUND OF THE INVENTION AND PRIOR ART

There is a dwindling availability of natural rosewood. Dalbergia nigra, or Brazilian Rosewood, which is considered to be the finest variety, is virtually unobtainable. Dalbergia latifolia, or East Indian Rosewood, is available on a limited basis in small dimension stock only. The cost of natural rosewood is very high, being about eight times the price of walnut, an available domestic wood which can conveniently be employed as starting material for the present invention.

Natural rosewood has become a rare, expensive, and highly-prized wood. Most uses of rosewood today are for such purposes as decorative inlay work, expensive furniture, musical instruments, expensive paneling, fancy handles, and the like.

Although problems of supply, quality, and cost preclude the use of rosewood in furniture and many other products, the popularity of, and demand for, rosewood has been, and continues to be, very strong. This is evident from many examples seen in furniture, accessory furnishings, musical instruments, sporting goods items, cutlery, and other products. The term rosewood is often used in reference to the finishes on these items.

The demand for rosewood is met in various ways including surface coloring of white woods by painting or staining them a "rosewood" color, the use of rosewood-colored plastics, and the use of white woods impregnated with rosewood colored dyes. None of these methods provides a satisfactory rosewood substitute and all have various shortcomings. Stained wood falls short of the quality of appearance which is obtained in wood which is finished in its natural color without the use of stains. This finish is easily abraded or damaged, revealing the underlying white wood. Plastics are unsatisfactory substitutes.

Several methods have been devised over the years to color-impregnate wood with various colors, including rosewood-like colors. These methods fall into the following general classifications: dye impregnation, dye/resin impregnation, dye/ resin impregnation and compression of wood. In the areas of dye impregnated and dye/resin impregnated woods, when "rosewood" colors are produced, they lack the intensity of the color of natural rosewood. It has also proven impossible to completely impregnate woods with these substances (5). There always remain certain areas in the wood which are impervious to the dyes or dye/resin combinations. This results in unattractive uncolored streaks being visible in the finished material. Ray cells are particularly impervious to dyes and areas of ray fleck figure are present in much of the wood which remains undyed. In an effort to overcome these difficulties, methods have been developed to dye thin sheets of wood veneer, these being more readily impregnated than lumber (5), and then to laminate the veneer sheets into stock of the desired thickness. This material is in common use in the archery industry for bow handles (6), but still fails to overcome the previously-noted shortcomings of dye-impregnated woods. In addition, it has the objectionable characteristic of looking like plywood, which is what it is. This material is suitable for certain specialized applications but its use is not widespread, and it most assuredly is not considered to be a rosewood substitute.

In the area of dye/resin impregnated and compressed wood, in a material generally known as "Compreg", more intense colors than those of previously-described materials are generally achieved. However, the problems associated with dye-impregnated wood, especially unimpregnated areas, remain in this material. In addition, it has the objectionable characteristics of looking like plywood, being extremely hard and heavy, being very brittle, and consisting more of resin than of wood. This material is in common use in the cutlery industry for handle material. However, its use is even more restricted than that of the previously-described laminated material and it is likewise not considered to be a rosewood substitute.

The desirable characteristics of the finest natural rosewood include, in addition to the primary characteristic of its color, susceptibility of polish, hardness, and durability (1,2).

The supply of natural rosewood today is characterized by availability in small dimensions only, inadequate and unreliable supply, and excessive cost.

The finest grade of natural rosewood is generally considered to be the species Dalbergia nigra, or Brazilian Rosewood. This rosewood is believed to excel all other varieties in the fineness, uniformity, depth, and intensity of its color (2). Heretofore it has been impossible to duplicate this color in artificially color-impregnated wood materials.

The art of impregnating wood is well known and widely practiced in industry. However, the complete impregnation of the entire structure and substance of woods is neither known nor practiced. It is of course not necessary or desirable in the wood preservation industry. It is not achieved in dye or dye-resin impregnated wood, as evidenced by the uncolored, unimpregnated areas which still remain in these products.

No Prior Art in this field is known to me except that noted and cited in my prior application of which the present application is a continuation-in-part, and such prior art is not considered relevant to the present invention.

It seems clear that the prior art has not provided any rosewood substitute, or any method of producing the same, much less such a method which is economically and commercially feasible, generally applicable to large wood sizes, and equivalent throughout its composition and substance to rosewood in its degree of rosewood color, darkness, depth, and intensity, which is stable and with no tendency for color bleed-out or fading. It also is apparent that the expense and relative unavailability of natural rosewood now places a suitable and satisfactory rosewood substitute, such as is provided by the present invention, and an economic and commercially-feasible process for the production thereof, into the category of a "long-awaited" development.

OBJECTS OF THE INVENTION

It is an object of this invention to provide a method of treating wood of the genus Juglans to render it essentially dark brown with conspicuous black streaks throughout its entire structure and substance. It is a primary object of the invention to provide a wood material which possesses certain desirable characteristics, especially a rosewood color of such fineness, uniformity, depth, and intensity, so that the wood can be used as a substitute for natural rosewood. Another object is to provide a rosewood substitute which possesses the necessary physical characteristics, which is available at a relatively low price, and which is available in ample supply so that its use can be expanded beyond the current uses of natural rosewood. An additional object is to provide a rosewood substitute which is a solid wood material and which is completely natural in appearance and other obvious physical characteristics. Still a further object is to provide a rosewood substitute which, in addition to color, emulates other desirable physical characteristics of natural rosewood. Still an additional object is to provide a rosewood substitute which overcomes certain undesirable physical characteristics of natural rosewood. Yet another object is to provide a method or procedure whereby it is possible to completely impregnate wood of the genus Juglans with suitable chemical materials or solutions which will impart a desired rosewood color and other characteristics throughout the entire structure and substance of the wood. Still further objects will become apparent hereinafter and yet additional objects will be apparent to one skilled in the art.

SUMMARY OF THE INVENTION

The invention, then, comprises the following, inter alia:

A method of treating wood of the genus Juglans to change its color completely and throughout the entire structure and substance thereof essentially to dark brown with conspicuous black streaks, thereby providing a rosewood substitute, comprising the following steps:

placing the starting wood into a vacuum/pressure vessel, drawing a vacuum in the vessel, preferably raising the temperature of the contents of the vessel, allowing the vessel to stand until essentially all the extractable water and air is extracted from the wood, introducing an aqueous solution of an iron salt having a concentration not greater than about eighteen percent (18%) by weight into the vessel, while maintaining the vacuum therein, thereafter preferably maintaining an elevated temperature and applying an elevated pressure inside of the vessel, allowing the vessel to stand until essentially the maximum possible amount of iron salt solution is absorbed by said wood, if necessary reducing the temperature of the contents of the vessel to ambient temperature, releasing the pressure in the vessel, draining fluid from the vessel, removing the wood from the vessel, washing the wood with water, and drying the thus-treated wood in a wood drying kiln at an elevated temperature between 130° F. and 180° F., preferably at about 155° F., to produce a synthetic rosewood product having a color consisting essentially of dark brown with conspicuous black streaks; such a method wherein the vacuum is monitored by means of a vacuum gauge during the vacuum step of the method and wherein the vacuum is reapplied at intervals over a period of several hours until a stable equilibrium is obtained as evidenced by a stable vacuum gauge reading; such a method wherein the pressure is monitored during the pressure step of the method and wherein the pressure is reapplied at intervals over a period of several hours until the pressure stabilizes as indicated by a stable pressure gauge reading; such a method wherein the aqueous iron salt solution is aqueous ferrous sulfate solution; such a method wherein the starting wood is selected from the group consisting of Juglans nigra, Juglans hindsii, Juglans regia, and Juglans cinerea; such a method wherein the vacuum is drawn to below about 50 mm of mercury; such a method wherein the vacuum is drawn to between about 0.025 mm and 0.001 mm of mercury; such a method wherein the temperature of the vessel during the vacuum step is preferably maintained between about 100 and 150° F.; such a method wherein the time of standing in the vacuum step is between about 3 and about 24 hours; such a method wherein the concentration of aqueous iron salt solution is between about 6 and up to about 18% by weight; such a method wherein the concentration of the ferrous sulfate solution is between about 8 and about 12% by weight; such a method wherein the pressure maintained the pressure step is between about 200 and about 800 pounds per square inch; such a method wherein the temperature in the reaction vessel during the pressure step is preferably maintained between about 100° and 250° F.; such a method wherein the time of standing during the pressure step is between about 3 and about 48 hours; such a method wherein the temperature in the reaction vessel during the pressure step is preferably maintained between about 100° and 150° F.; such a method wherein the aqueous iron salt solution is preheated before introduction into the vessel; and such a method wherein the aqueous ferrous sulfate solution is preheated to between about 100° and 150° F. before introduction into the reaction vessel; such a process wherein the vacuum is reapplied over a period of about three to eight hours; such a process wherein the pressure is reapplied over a period of about three to eight hours; and, finally, wherein the product is dried at a temperature of about 130° to 180° F., preferably about 155° F., to produce the desired product, which is wood of the genus Juglans which is characterized by a color consisting essentially of dark brown (in various shades) with conspicuous black streaks, throughout its entire structure and substance, thereby constituting a rosewood substitute, and especially such a product having a "built-in" finish, thus requiring only sanding, waxing, and buffing to impart a high sheen.

GENERAL DESCRIPTION OF THE INVENTION

According to the present invention, it has now been found that the impregnation of species of wood of the genus Juglans, in particular the heartwood thereof, which have a satisfactorily-high natural tannin content, with a solution of an iron salt, particularly but not limited to ferrous sulfate, especially under certain preferred operating conditions and along with certain preferred additional steps, will effectively create a wood with a color which is dark brown of various shades with conspicuous black stripes, which duplicates the fineness, uniformity, depth, and intensity of color of the finest natural rosewood and which may in addition possess other desirable characteristics which are imparted thereto by the process, thereby providing a synthetic rosewood substitute.

In one embodiment of the present invention, lumber of the species Juglans nigra is evacuated of all moisture and air and then impregnated with a ferrous sulfate solution having a concentration not greater than about eighteen percent (18%) by weight, followed by the specified drying, thereby producing the heretofore-mentioned rosewood substitute. The procedure used to accomplish this is critical and is fully explained in the detailed examples and elsewhere in this disclosure. The various species of Juglans, especially but not limited to Juglans nigra, are particularly applicable to the present invention. Juglans nigra is commonly known as American Black Walnut, American Walnut, or Walnut, and is hereinafter sometimes referred to simply as "walnut". Walnut is a heavy, hard, strong, stiff, durable wood with good shock resistance and good dimensional stability and machinability (7). It has attractive figure and texture. It is available in large dimensions, in grades which are virtually defect free. There is an ample supply of walnut as annual production of walnut lumber in the United States averages about 34,000,000 board feet (3). There has in fact been a surplus of walnut lumber in recent years (4).

All of the desirable characteristics of walnut are retained in the heretofore-mentioned rosewood substitute which is one embodiment of the present invention. In addition, certain characteristics of walnut are improved upon. The hardness of the material is ten to fifteen percent greater than natural walnut. The susceptibility to polish is greatly enhanced and is similar to that of natural rosewood. The machinability of the material is enhanced as it has been found to cut cleaner than natural walnut. Cuts made with high speed cutting machines, such as shapers, leave a very smooth and clean surface free of the fuzzy-like texture often encountered in natural walnut, particularly in end grain cuts. Sanding properties of the material are good and are not adversely affected by the treatment process. Durability of the material is increased due to a greater resistance to wood-destroying organisms which is imparted to the material by the impregnated chemicals, and it is characterized by an advantageously greater water resistance than walnut itself.

The ample supply of walnut lumber, which would translate into an ample supply of the rosewood substitute of the present invention, at a modest cost relative to rosewood, and in large dimensions virtually free of defect, will effectively overcome the obstacles currently preventing the widespread use of natural rosewood.

Complete impregnation of the subject wood is essential to impart the desired rosewood color and other characteristics throughout the entire structure and substance of the wood. The present invention provides a method to achieve complete impregnation. This method involves the use of vacuum, preferably heat, and pressure and is fully explained in the detailed examples and elsewhere in this disclosure.

In general, the method or process of the present invention is conducted in a single stage. The concentration of the reagent employed is a factor. When the concentration is in the ranges as specified herein, then the rosewood substitute can be produced.

In more detail with respect to the method of the invention, and the results obtained by employing the same, and varying the concentrations of reagent and other conditions employed in the method, it is to be noted as follows:

According to the single-stage method of the present invention, involving as it does a plurality of steps, the wood of the genus Juglans is treated to change its color completely and throughout the entire structure and substance thereof essentially to various shades of dark brown with conspicuous black streaks, by placing the starting wood into a vacuum/pressure vessel and drawing a vacuum in the vessel. The vacuum drawn in the vessel is preferably below 50 mm of mercury, and most preferably between 0.025 mm and 0.001 mm of mercury. The temperature of the contents of the vessel is then preferably raised, preferably to a temperature between about 100° and 150° F. From an economic standpoint, the employment of an elevated temperature is highly desirable, but where plant and tank availability presents no problem may be dispensed with in favor of a more protracted period of standing under vacuum. The vessel is then allowed to stand, until essentially all the extractable water and air is extracted from the wood, this ordinarily requiring a time period between about 3 and about 24 hours. During this time the vacuum is preferably monitored by means of a vacuum gauge and the vacuum reapplied at intervals over a period of several hours, e.g., over a period of 3 to 8 hours, until a stable equilibrium is obtained as evidenced by a stable vacuum gauge reading. As already stated, this stable vacuum gauge reading is preferably obtained at a vacuum below about 50 mm of mercury and most preferably between 0.025 mm and 0.001 mm of mercury.

The point at which essentially all of the extractable water and air is extracted from the wood is readily determined by the observation of the vacuum gauge and, after reapplication of vacuum at intervals over a period of several hours during the vacuum step, the stable equilibrium as evidenced by a stable vacuum gauge reading is also evidence of the fact that essentially all of the extractable water and air has been extracted from the starting wood.

Then, an aqueous solution of an iron salt, preferably ferrous sulfate, is introduced into the vessel while maintaining the vacuum therein, the concentration of the aqueous iron salt solution being not greater than about eighteen (18) percent by weight, preferably from about six to about eighteen percent by weight, and most especially between about eight and twelve percent by weight. The temperature of the solution introduced into the vessel is preferably, but not necessarily, raised, representatively to a temperature between about 100° and 150° F. The employment of a preheated solution is advantageous although not essential.

Thereafter an elevated temperature is preferably maintained in the vessel and an elevated pressure is applied inside the vessel. This elevated pressure is preferably between about 200 and 800 pounds per square inch. The same temperature considerations apply here as in the vacuum step.

The vessel is thereupon allowed to stand for a further period until essentially the maximum possible amount of the iron salt solution is absorbed by the wood. This generally involves a time period of between about 3 and about 48 hours. During this time the pressure is advantageously monitored and pressure reapplied at intervals over a period of several hours, e.g., 3–8 hours, until the pressure stabilizes as indicated by a stable pressure gauge reading. As already stated, this stable pressure gauge reading is preferably obtained at a pressure between about 200 and 800 pounds per square inch.

The elevated temperature preferably maintained inside the vessel during this period is preferably between about 100° and 250° F., most advantageously between about 100 and 150° F. When the pressure gauge stabilizes, this indicates that the maximum possible amount of the iron salt solution has been absorbed by the wood.

The temperature of the contents of the vessel is then if necessary reduced to ambient, the pressure in the vessel released, the fluid drained from the vessel, the wood removed from the vessel, the wood washed with water, the thus-treated wood kiln dried at a critical elevated temperature according to this invention, viz., at a temperature of about 130° F. to about 180° F., preferably about 155° F., to produce a synthetic rosewood product. The wood is preferably dried to a 6 to 12 percent EMC value and, when subjected to the usual surface treatments, such as sanding, buffing, lacquering, and/or waxing, as further indicated by the Examples, presents an outstanding finish which is remarkably like that of natural rosewood, having a so-called "built-in" finish which accepts a high sheen from mere waxing and buffing without more.

In both the vacuum step and the pressure step, the time the vessel is allowed to stand under vacuum or pressure is generally at least three hours and, depending upon the degree of vacuum and pressure and temperature applied, and the rapidity of the interval at which it is reapplied, may vary between about the minimum of three hours and the maximum as set forth in the foregoing, the entire procedure depending of course to some extent upon the condition and the size of the starting lumber treated, it being apparent to one skilled in the art that the smaller the size of the lumber treated the less stringent the conditions required and the less time required for each of the several steps.

It is accordingly to be noted that, when operating according to the single-stage method of the present invention, to produce a synthetic rosewood product, the utilization of an aqueous iron salt solution having a concentration not greater than about eighteen percent (18%) by weight and evacuation of essentially all of the extractable water and air from the starting wood, together with introduction of essentially the maximum possible amount of iron salt solution by absorption into the wood, are essential aspects of the invention, the latter two conditions being readily determined by monitoring the vacuum and pressure gauges during the respective steps of the method and preferably reapplying the vacuum or pressure at intervals over a period of time until a stable equilibrium is obtained, as evidenced by a stable vacuum or pressure gauge reading, which is in turn indicative of the fact that essentially all of the extractable water and air has been extracted from the wood and the fact that essentially the maximum possible amount of iron salt solution has been absorbed by the wood. Further details of the method and product of the invention will be apparent from the detailed Examples which follow.

DETAILED DESCRIPTION OF THE INVENTION

The invention will be more fully understood by reference to the following detailed Examples, which are given by way of illustration only and are not to be construed as limiting.

EXAMPLE 1

A 1¾ in.×4¼ in.×20 in. American walnut board, kiln dried to 6 percent equilibrium moisture content (EMC), was placed in a vacuum/pressure vessel. A vacuum of 0.001 mm Hg was drawn by means of a two-stage rotary vane type vacuum pump. Heat was applied to the vessel by means of an electric heat strap placed around the vessel and the temperature of the vessel and its contents was raised to 150° F. The vessel was allowed to stand for a period of 12 hours, by which time the vacuum gauge had stabilized. At the end of this 12 hour period, a ten percent (10%) aqueous solution of ferrous sulfate (by weight), carefully filtered and heated to 150° F., was introduced into the vessel, while maintaining the vacuum. Pressure of 500 lbs. per square inch was then applied inside the vessel by means of a hydraulic pump. Heat was applied to the vessel and the temperature of the vessel and its contents was maintained at 150° F. The vessel was allowed to stand for a period of 24 hours, by which time the pressure had stabilized. At the end of this 24 hour period, the temperature was lowered to the ambient level and the pressure inside the vessel released. The vessel was drained of the ferrous sulfate solution and the walnut board removed. The board was washed in plain water and allowed to air dry for one day. The board was then kiln dried at a temperature of about 155° F. to an EMC of 6 percent.

The board was then sawn across its width at one inch intervals for one-half of its length and was found to have a definitive color consisting essentially of various shades of dark brown with conspicuous black streaks throughout. The remaining one-half of the board was sawn through the center of its length and also found to be the same color throughout. The edges exposed in the previous step were sanded and lacquered. The finished wood exhibited a rosewood color of the same intensity and quality as that of the finest natural rosewood samples, of the species Dalbergia spp., that could be obtained, and the color did not bleed or fade.

The following Examples are identical to EXAMPLE 1 except for variations as noted:

EXAMPLE 2

During the vacuum step of the treatment, a vacuum gauge was monitored. It was observed that, after an initial vacuum of 0.025 mm Hg to 0.001 mm Hg was drawn, the gauge reading slowly rose. This was determined to be caused by the slow escape of trapped air and moisture from the wood. It was found that the reapplication of the vacuum pump, repeated at 30-minute intervals, over a period of 3 to 4 hours, eventually resulted in a stable vacuum gauge reading at the desired level of 0.025 mm Hg to 0.001 mm Hg. It was deduced that, at this point, using the given procedure, the maximum possible amount of air and moisture had been extracted from the wood, rendering it in the best possible condition to be impregnated with a fluid in the next step of the treatment procedure.

Likewise, during the ferrous sulfate/pressure step of treatment, a pressure gauge was monitored. It was observed that, after an initial pressure of 200 to 800 lbs. per square inch was applied, the gauge reading slowly dropped. This was determined to be due to the slow absorption of the fluid by the wood and to the fact that a period of time was required for the fluid to work completely into the wood structure. It was found that the reapplication of pressure, repeated at 30-minute intervals over a period of 3 to 8 hours, eventually resulted in a stable pressure gauge reading at the desired level of 200 to 800 lbs. per square inch. It was deduced that at this point, using the given procedure, the maximum possible impregnation of the wood structure had occurred.

The product is worked up and subjected to kiln drying at various temperatures between about 130° and 180° F. Results are the same as in Example 1. A temperature of 150–160° F. is preferred and appears to give entirely satisfactory results. The characteristics of the product are equal to those of the product of Example 1 or superior thereto.

EXAMPLE 3

A temperature of 225° F. is used in the ferrous sulfate step of treatment. Workup and drying are in accord with Example 2. Results obtained are similar to those of Example 1.

EXAMPLE 4

A period of 24 hours is used in the vacuum step, and 48 hours is used in the ferrous sulfate step. The results obtained are similar to those of Example 1.

EXAMPLE 5

Pressure of 800 lbs. per square inch is applied in the ferrous sulfate step. The results obtained are similar to those of Example 1.

EXAMPLE 6

A sample of the wood product obtained in Example 1 was sanded to a very smooth finish. A high quality wood wax was applied to the sanded surfaces and allowed to dry. The wood was then buffed on a lathe using 12-inch cotton buffs turning at 1200 RPM. A very high sheen was obtained. It was a much higher sheen than that possible to obtain on natural walnut and was similar to that possible to obtain on natural rosewood. The product had a "built-in" finish in that it required only waxing and buffing, even without application of lacquer or oil.

EXAMPLE 7

A sample of the wood product obtained in Example 1 is cut to a size of 1½ in.×1½ in.×½ in. and placed in an airtight sterilized jar in which a sample of moistened earth is also placed. A second jar, identical to the first, is prepared and an untreated walnut sample, identical in size to the treated sample, is placed in it. After a period of several months it is observed that the untreated walnut has a mold growth on its surface, while the treated walnut has no growth upon it.

EXAMPLE 8

An 18 percent aqueous solution of ferrous sulfate is used. The results obtained are similar to those of Example 1.

EXAMPLE 9

An 8 percent aqueous solution of ferrous sulfate is used. The results obtained are similar to those of Example 1.

EXAMPLE 10

Following Example 2, a temperature of 250° F. is used in the ferrous sulfate step of treatment. Results obtained are similar to those of Example 1.

EXAMPLE 11

Following Example 2, a period of 10 hours is used in the vacuum step, and 20 hours is used in the ferrous sulfate step. The results obtained are similar to those of Example 1.

EXAMPLE 12

Following Example 2, a pressure of 200 lbs. per square inch is applied in the ferrous sulfate step. The results obtained are similar to those of Example 1.

EXAMPLE 13

Following Example 2, a 12 percent aqueous solution of ferrous acetate is used. The results obtained are similar to those of Example 1.

EXAMPLE 14

Following Example 2, a 12 percent aqueous solution of ferrous sulfate is used. The results obtained are similar to those of Example 1.

EXAMPLE 15

Following Example 2, a 6 percent aqueous solution of ferrous sulfate is used. The results obtained are similar to those of Example 1.

EXAMPLE 16

Following Example 2, a 10 percent aqueous solution of ferrous chloride is used. The results obtained are similar to those of Example 1.

EXAMPLE 17

A sample of the wood product obtained in Example 1 is fashioned into a letter opener having an approximate length of 9½ inches, handle width of one inch, and handle thickness of 11/32 inch. The blade of this letter opener is tapered to a rounded point of approximately 3/16 inch diameter and thickness of 0.090 inch. A similar letter opener is fashioned of untreated walnut. Both samples are put through six complete cycles of an automatic dishwashing machine, both at the same time, with complete drying of the samples between dishwasher cycles. The untreated walnut sample is found to have significant warpage of the blade and "raised grain" on the handle. The treated sample is found to have no noticeable effects from the dishwasher cycles, other than slight dulling of the surface which is readily removed by hand buffing.

ADDITIONAL EXAMPLES

When the procedure of the preceding examples is repeated, employing instead of the American Walnut (Juglans nigra) wood as starting material, numerous other species of Juglans, including Claro Walnut (Juglans hindsii), Circassian Walnut (Juglans regia), and Juglans cinerea, the results are essentially the same as set forth in the preceding examples except for slight differences in the grain of the wood as would be expected from the differences in the starting materials employed.

When the ferrous sulfate solutions employed in the preceding examples are replaced by other ferrous or ferric salt solutions, such as ferrous acetate, ferrous chloride, or ferric chloride, or the like, the results are essentially the same although ferrous sulfate solutions are preferred. Expected variations within the range of concentrations of the iron salt are experienced, for example, it is usually desirable to employ a solution of ferrous acetate relatively high in the specified concentration range rather than relatively low in the specified concentration range to obtain the same result as is achieved with a corresponding ferrous sulfate solution.

Rosewood-dyed laminated veneer, marketed as archery bow handle stock, was examined from the standpoint of its depth of color, completeness of color and its suitability as a rosewood substitute. Unimpregnated areas were apparent throughout the material, on the surface thereof as well as in a cross section of the veneer itself, and only a pale color characterized the product. The pale color could not be substantially improved or darkened by normal waxing or polishing procedure. The material, even when so finished, was totally unsuitable as any kind of a rosewood substitute.

When "equilibrium moisture content" or "EMC" is used herein, this refers to the moisture content at which the wood is neither gaining nor losing moisture. Accordingly, an equilibrium condition has been reached. There is a definite relationship between equilibrium moisture content, relative humidity, and temperature, and this is well understood in the art, as indicated, for example, on pages 3-6 and 3-7 of the U.S. Forest Products Laboratory publication entitled "Wood Handbook: Wood as an Engineering Material" (1974) otherwise identified as U.S.D.A. Agr. Handb. 72, rev., obtainable from the Superintendent of Documents, U.S. Government Printing Office, Washington, D.C. 20402 as stock number 001-000-03200-3.

It is thereby seen from the foregoing that the objects of the present invention have been accomplished and that a suitable and satisfactory rosewood substitute, having full and complete coloring throughout its entire structure and substance, has been provided thereby, as well as an economic and commercially practicable method for the production thereof, and whereby all of the previously-mentioned objectives have been attained.

Although the preferred embodiments of the invention have been illustrated and described in the foregoing description, it is to be understood that the invention is not limited to the embodiments disclosed or to the exact details of operation or exact compounds, compositions, method or procedures shown and described, since the invention is capable of numerous modifications, rearrangements, and substitutions of parts and elements and other equivalents, both chemical and physical, without departing from the spirit or scope of the invention, as will readily be apparent to one skilled in the art, and the invention is therefore to be limited only by the full scope which may be legally accorded to the appended claims.

REFERENCES CITED BY NUMBER

1. Fine Hardwoods Selectorama, p. 45, pub. by Fine Hardwoods/American Walnut Association, Indianapolis, IN.
2. Constantine, Albert, Jr., "Know Your Woods", pp. 290–292, 1975, pub. by Charles Scribner's Sons, New York, NY.
3. Current Industrial Reports, United States Bureau of Census 1982, 1983.
4. Fine Hardwoods/American Walnut Association, 5603 West Raymond Street, Suite "O", Indianapolis, In. 46241.
5. Seborg, Ray M. and Vallier, A. E., "Application of Impreg for Patterns and Die Models", Forest Products Journal, p. 305, October 1954.
6. 1986 Catalog, Bear Archery Co., 4600 Southwest 41st Boulevard, Gainesville, Fla. 32601.
7. Wood Handbook, Forest Products Laboratory, Forest Service, U.S. Department of Agriculture, Agriculture Handbook No. 72, pp. 1–13, August 1974.

I claim:

1. A method of treating wood of the genus Juglans to change its color completely and throughout the entire structure and substance thereof essentially to various shades of dark brown with conspicuous black streaks, thereby providing a rosewood substitute, comprising the following steps:

placing the starting wood into a vacuum/pressure vessel, drawing a vacuum in the vessel, allowing the vessel to stand until essentially all the extractable water and air is extracted from the wood, introducing an aqueous solution of an iron salt having a concentration not greater than about eighteen percent (18%) by weight into the vessel, while maintaining the vacuum therein, thereafter applying an elevated pressure inside of the vessel, allowing the vessel to stand until essentially the maximum possible amount of iron salt solution is absorbed by said wood, releasing the pressure in the vessel, draining fluid from the vessel, removing the wood from the vessel, washing the wood with water, and drying the thus-treated wood at an elevated temperature of about 130° F. to about 180° F. to produce a synthetic rosewood product.

2. The method of claim 1, wherein the vacuum is monitored by means of a vacuum gauge during the vacuum step of the method and wherein the vacuum is reapplied at intervals over a period of several hours until a stable equilibrium is obtained as evidenced by a stable vacuum gauge reading.

3. The method of claim 2, wherein the pressure is monitored during the pressure step of the method and wherein the pressure is reapplied at intervals over a period of several hours until the pressure stabilizes as indicated by a stable pressure gauge reading.

4. The method of claim 1, wherein the aqueous iron salt solution is aqueous ferrous sulfate solution.

5. The method of claim 1, wherein the starting wood is selected from the group consisting of Juglans nigra, Juglans hindsii, Juglans regia, and Juglans cinerea.

6. The method of claim 2, wherein the vacuum is drawn to below about 50 mm of mercury.

7. The method of claim 6, wherein the vacuum is drawn to between about 0.025 mm and 0.001 mm of mercury.

8. The method of claim 2, wherein the temperature of the vessel during the vacuum step is maintained between about 100° and 150° F.

9. The method of claim 1, wherein the time of standing in the vacuum step is between about 3 and about 24 hours.

10. The method of claim 1, wherein the concentration of aqueous iron salt solution is between about 6 and about 18% by weight.

11. The method of claim 4, wherein the concentration of the ferrous sulfate solution is between about 8 and about 12% by weight.

12. The method of claim 1, wherein the pressure maintained during the pressure step is between about 200 and about 800 pounds per square inch.

13. The method of claim 1, wherein the temperature maintained in the reaction vessel during the pressure step is between about 100° and 250° F.

14. The method of claim 1, wherein the time of standing during the pressure step is between about 3 and about 48 hours.

15. The method of claim 13, wherein the temperature maintained in the reaction vessel during the pressure step is between about 100° and 150° F.

16. The method of claim 1, wherein the aqueous iron solution is preheated before introduction into the vessel.

17. The method of claim 16, wherein the aqueous ferrous sulfate solution is preheated to between about 100° and 150° F. before introduction into the reaction vessel.

18. The method of claim 2, wherein the vacuum is reapplied over a period of about three to eight hours.

19. The method of claim 3, wherein the pressure is reapplied over a period of about three to eight hours.

20. The method of claim 1 wherein the drying temperature is about 155 degrees F.

21. A method of treating wood of the genus Juglans to change its color essentially to dark brown with conspicuous black streaks consisting essentially of the steps of introducing the starting Juglans wood into a vacuum/pressure vessel, drawing a vacuum in the vessel, allowing the vessel to stand at an elevated temperature until essentially all of the extractable water and air are extracted from the wood, and impregnating the wood with an aqueous solution of an iron salt at an elevated temperature and pressure to cause coloring of the wood essentially throughout, and drying the thus-treated wood at a temperature of about 130 to about 180 degrees Fahrenheit to produce a wood product having a color which is essentially dark brown with conspicuous black streaks.

22. A method of treating wood of the genus Juglans to change its color essentially to dark brown with conspicuous black streaks, consisting essentially of the following steps:

placing the starting wood into a vacuum/pressure vessel drawing a vacuum in the vessel to below about 50 mm of mercury, allowing the vessel to stand for a period between about 3 and 24 hours at a temperature between about 100° and 150° F. until essentially all the extractable water and air is extracted from the wood, introducing an aqueous solution of an iron salt having a concentration between about six (6) and not greater than about eighteen (18) percent by weight into the vessel, while maintaining the vacuum therein, thereafter applying an elevated pressure inside of the vessel between about 200 and about 800 pounds per square inch, allowing the vessel to stand for a period between about 3 and about 48 hours at a temperature between about 100° and 250° F. until essentially the maximum possible amount of iron salt solution is absorbed by said wood, releasing the pressure in the vessel, draining fluid from the vessel, removing the wood from the vessel, washing the wood with water, and drying the thus-treated wood at a temperature of about 130 to about 180 degrees Fahrenheit to produce a synthetic rosewood product having a color which is essentially dark brown with conspicuous black streaks.

23. Wood of the genus Juglans characterized by being various shades of dark brown with conspicuous black streaks throughout its entire structure and substance thereby constituting a rosewood substitute, produced according to the method of claim 21.

24. The product of claim 23, having a high sheen, being sanded, waxed, and buffed.

* * * * *